US007810190B1

(12) United States Patent
Antonio

(10) Patent No.: US 7,810,190 B1
(45) Date of Patent: Oct. 12, 2010

(54) SPLIT-APART BASKET STRETCHER

(76) Inventor: Ismael Antonio, 4804 Juneau Hills, Rio Rancho, NM (US) 87124

( * ) Notice: Subject to any disclaimer, the term of this patent is extended or adjusted under 35 U.S.C. 154(b) by 0 days.

(21) Appl. No.: 12/631,403

(22) Filed: Dec. 4, 2009

(51) Int. Cl.
*A61G 1/013* (2006.01)
*A61G 1/02* (2006.01)

(52) U.S. Cl. ..... 5/627; 5/625

(58) Field of Classification Search ..... 5/625–629, 5/81.1 R, 86.1, 620, 201, 114
See application file for complete search history.

(56) References Cited

U.S. PATENT DOCUMENTS 1,557,647 A * 10/1925 Austin ..... 5/628
3,336,060 A * 8/1967 Bradford ..... 403/108
3,426,367 A * 2/1969 Bradford ..... 5/626
3,890,659 A * 6/1975 Staubs ..... 5/625

* cited by examiner

*Primary Examiner*—Robert G Santos
(74) *Attorney, Agent, or Firm*—Roy Kiesel

(57) ABSTRACT

Disclosed is an improved Stokes-type basket stretcher constructed to permit its upper and lower units to be reassembled to hold rescue equipment for storage or transport to a rescue site. The lower unit frame includes one or more rail members having affixed thereto a series of rib members. The top rail member is generally U-shaped having a coupler support structure extending vertically upward and provided with either the male or female mating coupler member. The upper unit frame is similarly constructed except the other coupler mating member is affixed to align with its corresponding lower unit mating member to form a pocket of predetermined size.

10 Claims, 5 Drawing Sheets

SPLIT-APART BASKET STRETCHER

BACKGROUND OF THE INVENTION

1. Field of the Invention

This invention relates in general to basket stretchers and more particularly to split-apart basket stretchers.

2. Prior Art

The use of stretchers to move injured persons is well known. However, in many cases the ability to transport the stretcher and corresponding rescue equipment is made difficult by the location of the injured person. Special difficulties are encountered if the location is not near a road or is in rugged terrain or at significant heights above the ground such as television or similar tower construction or in multi-story fire rescue scenarios. It is not uncommon to have to fly or helicopter to the site and/or then hike some distance and/or then climb or rappel to the actual accident site and/or reverse this travel when bringing out the injured person.

This requires that the stretcher be as compact and as light as possible, yet at the same time form a sturdy and rugged structure when carrying the injured person from the rescue site. Some of these problems have been addressed through the use of lightweight but strong titanium tubing in the construction of the stretcher frame. Other problems have been addressed by shaping the stretcher frame to make it easier for the rescue team to lift and carry the stretcher with the injured person secured in the stretcher, as well as minimizing snagging the stretcher on surrounding structures or rocks or tree branches when rappelling or hauling up the injured person strapped to the stretcher. Stretcher designs such as the split-apart or Stokes-type basket stretcher have been used to compact the stretcher for transport by plane or helicopter.

However, not addressed by these prior art designs is the corresponding problem of how to transport the rescue equipment. Depending on rescue site and the nature of the injury the amount and weight of rescue equipment can be daunting. A typical rescue individual equipment kit may contain 15 or more separate items per person, plus a rescue team equipment kit may contain an additional 40 or more separate items. In addition to the problem of how to store and transport this large quantity of items, the weight of the items may be in the hundreds of pounds and in excess of a thousand pounds if pneumatic shoring equipment will be required in a cave in scenario to get to the injured person or rescue site.

There is a need in the rescue industry for better ways to transport the rescue equipment along with the stretcher that meet the requirements of compactness, reduces potential loss of the needed rescue equipment through packing and transporting, and better facilitates getting the rescue equipment to the accident site.

OBJECTS AND SUMMARY OF THE INVENTION

Therefore, one object of this invention is to provide a split-apart basket stretcher that can be compactly configured during transport to the rescue site to securely hold the needed rescue equipment.

Another object of this invention is to provide a split-apart basket stretcher that is constructed to be easily and quickly assembled for configuration to securely hold the needed rescue equipment.

Still another object of this invention is to provide a split-apart basket stretcher that is lightweight and sturdy when configured as a stretcher, but is also sufficiently sturdy when configured as a rescue equipment storage unit for use in transporting the rescue equipment to the accident site.

Another object of the invention is to provide a split-apart type stretcher having a wheel assembly and an extendable handle assembly to facilitate pulling or pushing the stretcher when in the storage configuration.

Other objects and advantages of this invention shall become apparent from the ensuing descriptions of the invention.

Accordingly, the split-apart or Stokes-type basket stretcher of this invention comprises two separable units, the head or upper unit and the foot or lower unit, that can be attached in two separate configurations. The first configuration is for use in transporting an injured person from the accident site. The second configuration is for use in storing and transporting rescue equipment to the accident site. Each of the two units is constructed having one or more vertically separated, generally U-shaped longitudinal or rail members that are fixed relative to one another by a series of separated lateral or rib members that are welded to the longitudinal members to faun a general shallow basket shaped frame. A relatively rigid plank constructed from molded high density polyethylene (HDPE) or other similar material may be affixed to the lateral members to provide for a more stable bed on which the injured party may be placed. The plank will also be separable with a first portion affixed to the head unit and a second portion affixed to the foot unit. In addition, a non-metallic mesh or netting for each unit may be fixed to the longitudinal members of the respective unit to form a floor and/or side walls for the stretcher to assist in holding the injured person in the stretcher, or in the alternate stretcher equipment transport configuration for preventing stored items from falling out of the pocket formed in this configuration. Also, if desired multiple adjustable straps may be attached to the longitudinal members to securely hold the injured party in the stretcher. To fix the two units together to form the stretcher the longitudinal members are constructed whereby their exposed ends can be aligned and attached together by any of a number of well known coupling devices.

In this invention the upper longitudinal member of the foot unit have struts mounted to its top surface to extend vertically upward. In a preferred embodiment there will be at least three struts. One strut will be positioned in the middle section of the upper longitudinal member and one strut will be positioned on each leg area of the upper longitudinal member. Each such strut has a coupler which can take the form of any of many known coupling devices. In addition the upper longitudinal member of the head section has a coupler affixed thereto at a position to operatively mate with a corresponding strut coupler to fix the two units facing each other at a predetermined distance to form a storage cavity sized to contain the desired rescue equipment.

In another preferred embodiment a pair of wheels are rotatably mounted on an axle affixed to a longitudinal member of the foot unit is provided to facilitate transporting the rescue equipment to the rescue site and transporting an injured person away from the rescue site. In this embodiment it is also preferred that a handle that is extendedly attached to the longitudinal members of the head unit in a lockable manner to fix the handle in either a transport position or in an operational position.

BRIEF DESCRIPTION OF THE DRAWINGS

The accompanying drawings illustrate preferred embodiments of this invention. However, it is to be understood that these embodiments are not intended to be exhaustive, nor limiting of the invention. They are but examples of the preferred construction of the split-apart basket stretcher of this invention.

PREFERRED EMBODIMENTS OF THE INVENTION

Without any intent to limit the scope of this invention, reference is made to the figures in describing the preferred embodiments of the invention.

Figure 2:
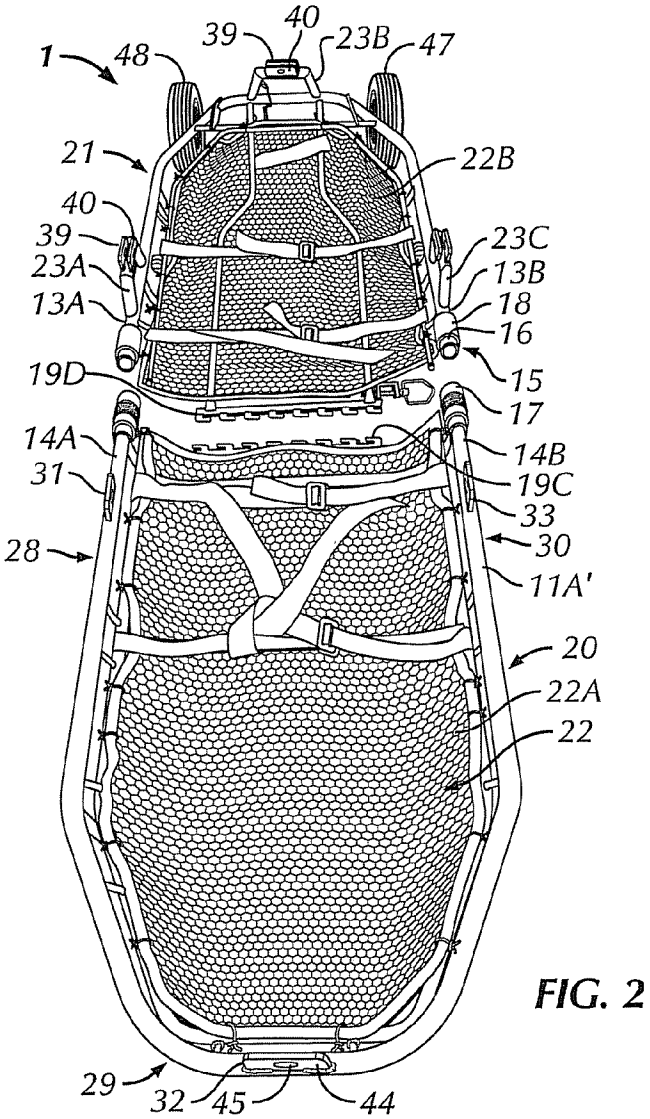
FIG. 2 is a perspective view of one embodiment of the split-apart basket stretcher of this invention illustrating the head unit separated from the foot unit and further illustrating a preferred positioning of the struts and couplers used to join the two units to form the rescue equipment transport configuration.
Figure 1:
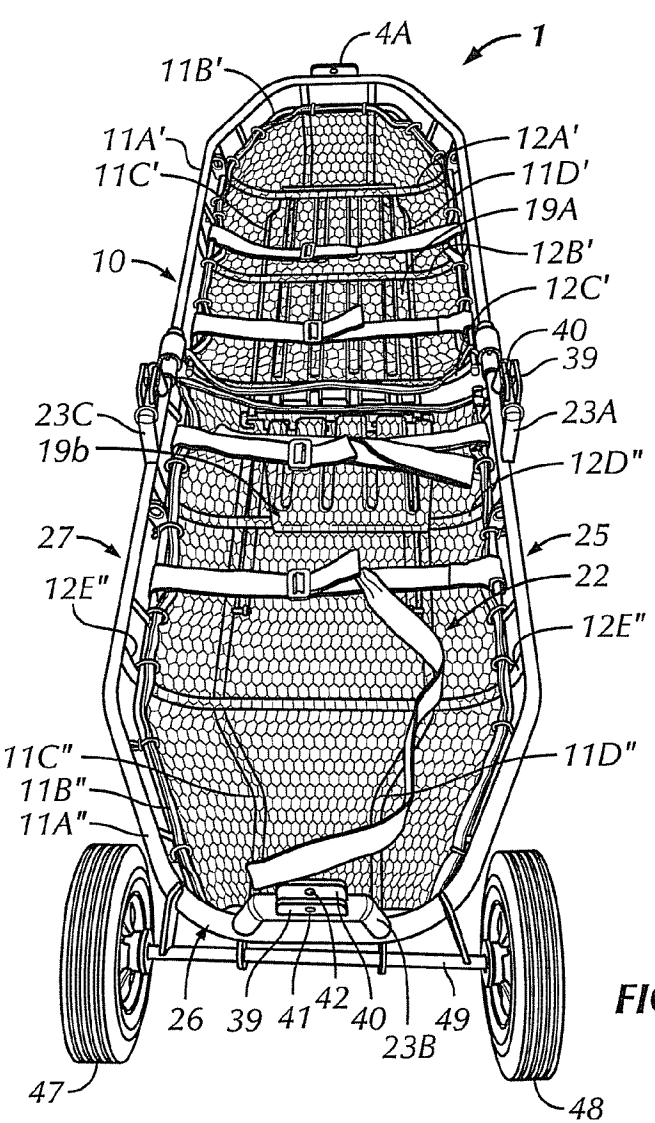
FIG. 1 is a perspective view of a preferred embodiment of the split-apart basket stretcher of this invention assembled in the stretcher configuration.
Figure 3B:
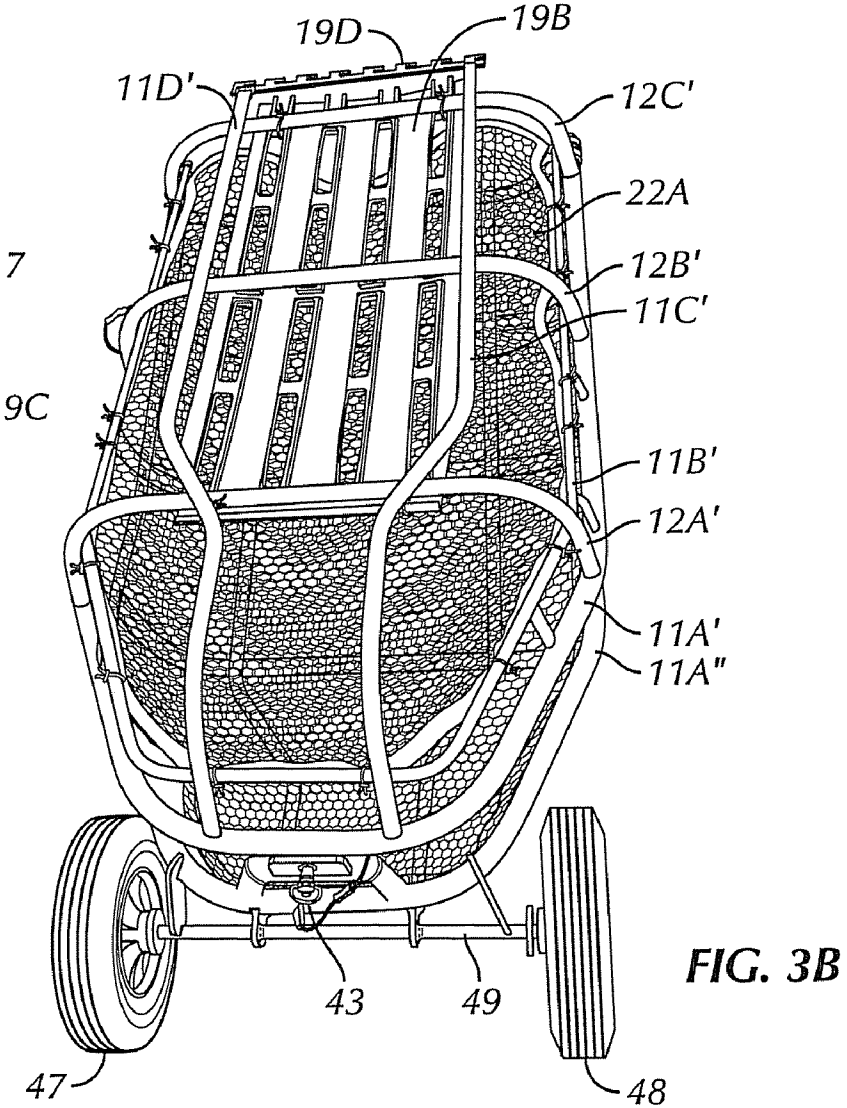
FIGS. 3A-3B are two different three-quarter perspective views illustrating the front and back views of a preferred embodiment of the split-apart basket stretcher of this invention assembled in the rescue equipment transport configuration.
Figure 3A:
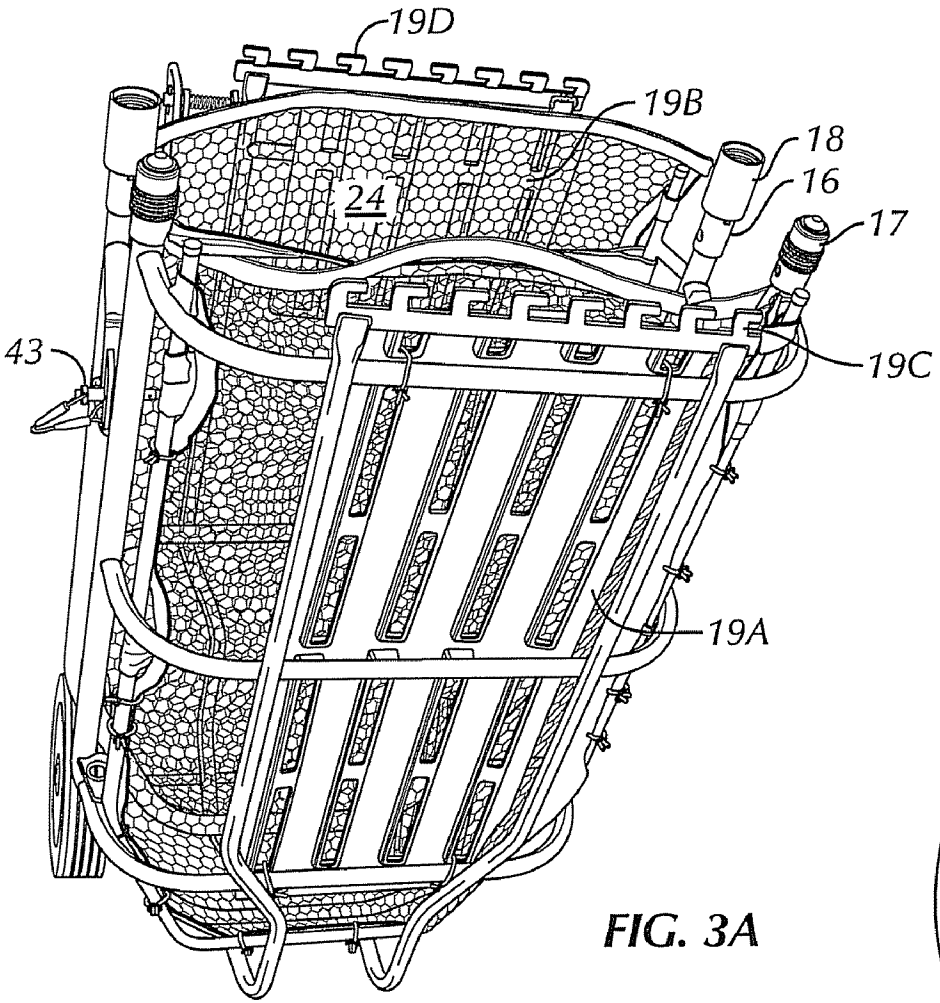
Figure 4:
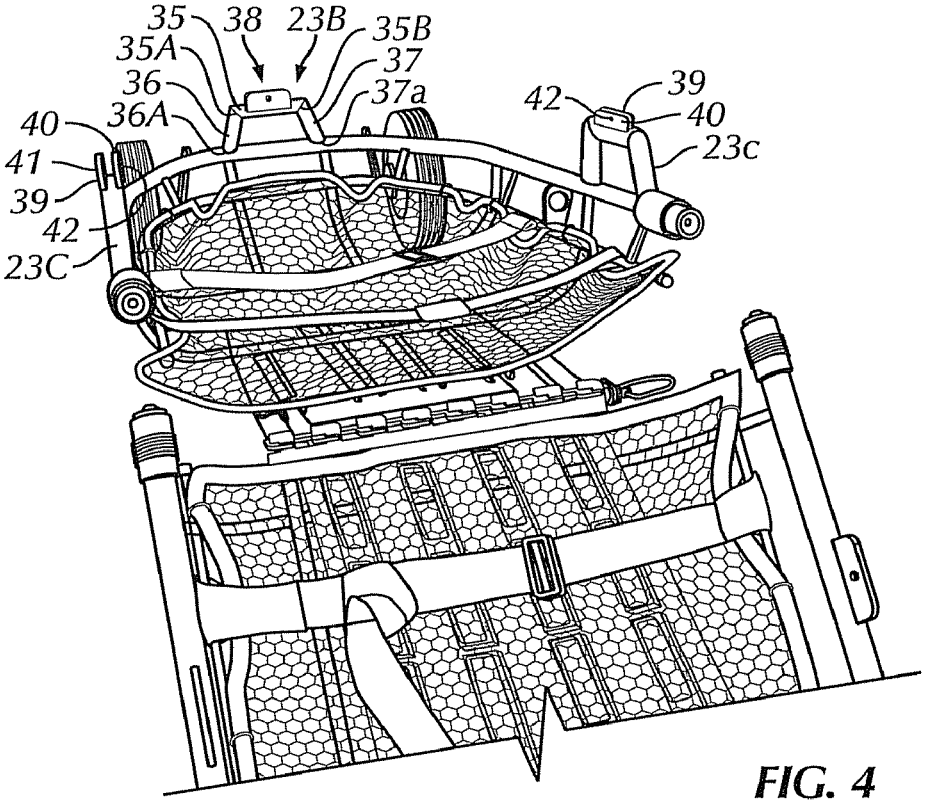
FIG. 4 is an enlarged view of the struts and couplers illustrated in FIG. 2.

As seen in FIG. 1 and FIG. 2 basket rescue stretcher 1 includes a frame 10 constructed utilizing longitudinal and lateral members such as rails 11 and ribs 12, respectively. Rails 11A-11D and ribs 12A-12E are welded together to form the rigid elongated low-sided basket-shaped frame 10. To form the split-apart embodiment of frame 10, rails 11A-11C are each constructed as two-pieces. The first piece of each rail 11 is the head rail piece 11A'-11C' and the second piece of each rail 11 is the foot rail piece 11A"-11C". Each pair of the corresponding rails ends 13A, 14A and 13B, 14B is fitted with coupler 15 to permit rails 11A-11C to be joined to form the rigid basket frame 10. A preferred coupler 15 includes a threaded male-end coupling 16, a corresponding female-end coupling 17 for mating with coupling 16, and a threaded collet, collar or sleeve 18. In combination, the three components when mounted on opposing corresponding rail ends 13 and 14 may be employed in known fashion to releasably lock the opposed rail ends 15 and 16 in longitudinally-aligned abutting or adjacent relation. Other commonly known coupling devices could also be used.

Conventional basket stretchers, including split-apart basket stretchers 1, also typically include a high density polyethene (HDPE) elongated body support board 19 affixed to ribs 12 where they attach to lower rails 11C, 11D to provide support for the back of the injured person who is placed in the stretcher. In a split-apart basket stretcher 1 the board 19 is constructed of two parts: head part 19A and foot part 19B. Part 19A is affixed to the head unit 20 and the other part 19B is affixed to the foot unit 21. In turn the ends of each part 19A and 19B have coupling means, such as off-set locking fingers 19C and corresponding off-set locking fingers 19D, to permit the two parts 19A and 19B to be easily and quickly attached to form a single support board 19 or easily and quickly detached when forming the rescue equipment transport and/or storage configuration.

It is also common for a flexible netting 22 to be affixed to one of the rails 11 to provide additional support for the legs and/or head of the injured person lying in the stretcher. Again for a split-apart basket stretcher netting 22 will comprise two separate pieces 22A and 22B. Piece 22A will be attached to the head unit 20 and piece 22B will be attached to the foot unit 21.

In preferred embodiments of basket stretchers top rail 11A typically is constructed having a circular cross-section and sized to provide a surface easy to grip and which will minimize hand fatigue or cramping when the rescue team has to carry the stretcher for long periods of time.

As illustrated in FIGS. 1-5 an improved split-apart basket stretcher 1 is constructed having struts 23A-23C welded or otherwise affixed to the foot unit top rail 11A". Foot unit top rail 11A" is made up of a first leg section 25, a middle section 26 and a second leg section 27. In a preferred embodiment strut 23A will be affixed to first leg section 25, strut 23B will be affixed to middle section 26, and strut 23C will be affixed to second leg section 27. In this preferred embodiment struts 23A-23C will extend vertically from the top surface of top rail 11A" a predetermined distance to form the sized rescue equipment storage pocket 24 desired. Head unit top rail 11A' is also made up of a first leg section 28, a middle section 29 and a second leg section 30. Affixed to each of sections 28-30 is a support structure 31-33, respectively. For each strut 23A-23C will be a corresponding support structure 31-33 which when the foot unit 21 faces head unit 20 the corresponding struts and support structures will be alignable and attachable to one another.

Figure 5:
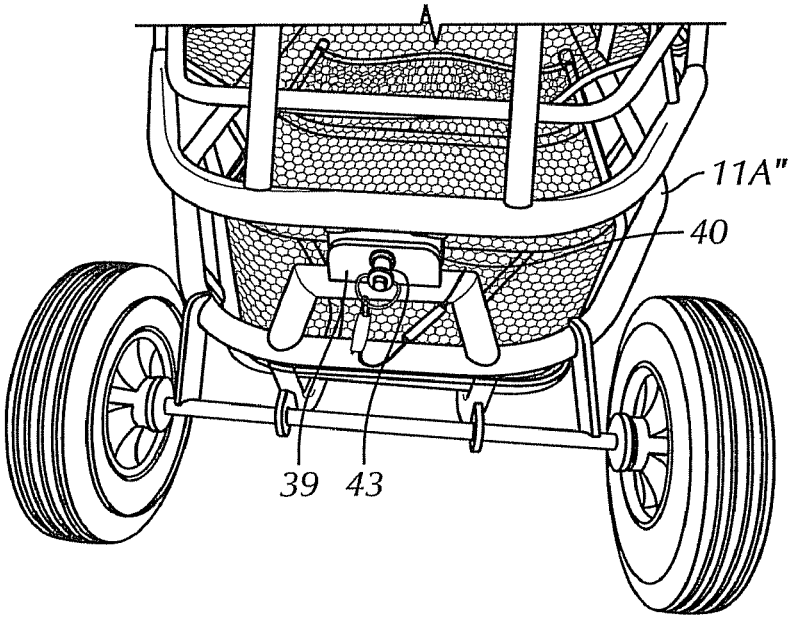
FIG. 5 is a perspective view of the wheel assembly of this invention.

In a preferred embodiment each strut 23A-23C is constructed from a tubular member 34 having a center flat section 35 that from each end 35A and 35A extend at downward angles leg sections 36 and 37, respectively. The extending ends 36A and 37A of leg sections 36 and 37, respectively, are welded are otherwise affixed to the top surface of top rail 11A'. Affixed to center flat section 35 is a coupling device 38. To provide a rigid and strong connection it is preferred that the coupling device 38 comprise parallel, but separated metal plates 39, 40 each having opening 41, 42, respectively, through which a bolt, screw, cotter pin or similar attaching device 43 can be asserted. In this embodiment, each support structure 31-33 will include a metal plate 44 positioned and sized to fit between the separated metal plates 39, 40. Plate 44 will also be provided with an opening 45 that will be alignable with openings 41, 42 when plate 44 is inserted between plates 39, 40. With the openings of plates 39, 40 and 44 aligned, attaching device 43 can then be inserted through the openings to affix the head section 13 and foot section 14 together as seen in FIG. 5. With the facing head unit 20 and foot unit 21 being attached a pocket 24 is formed into which rescue equipment can be stored for transport.

In an alternate preferred embodiment, a pair of wheels 47 and 48 is rotatably mounted on axle 49 affixed to foot section top rail 11A". This embodiment is useful in pushing or pulling the stretcher/storage structure 1 when transporting an injured person or rescue equipment over flat terrain. In such cases it permits the transporting to be done by a single person rather than 3-4 rescue members.

In another preferred embodiment each netting piece 22A and 228 will be affixed to the top rail 11A to form both a floor and side walls for each basket unit 20 and 21 to better ensure that all legs and arms of the injured person remain within the basket 1 in the person transport configuration and that all rescue equipment remains within the pocket formed in the equipment transport configuration.

Figure 6A:
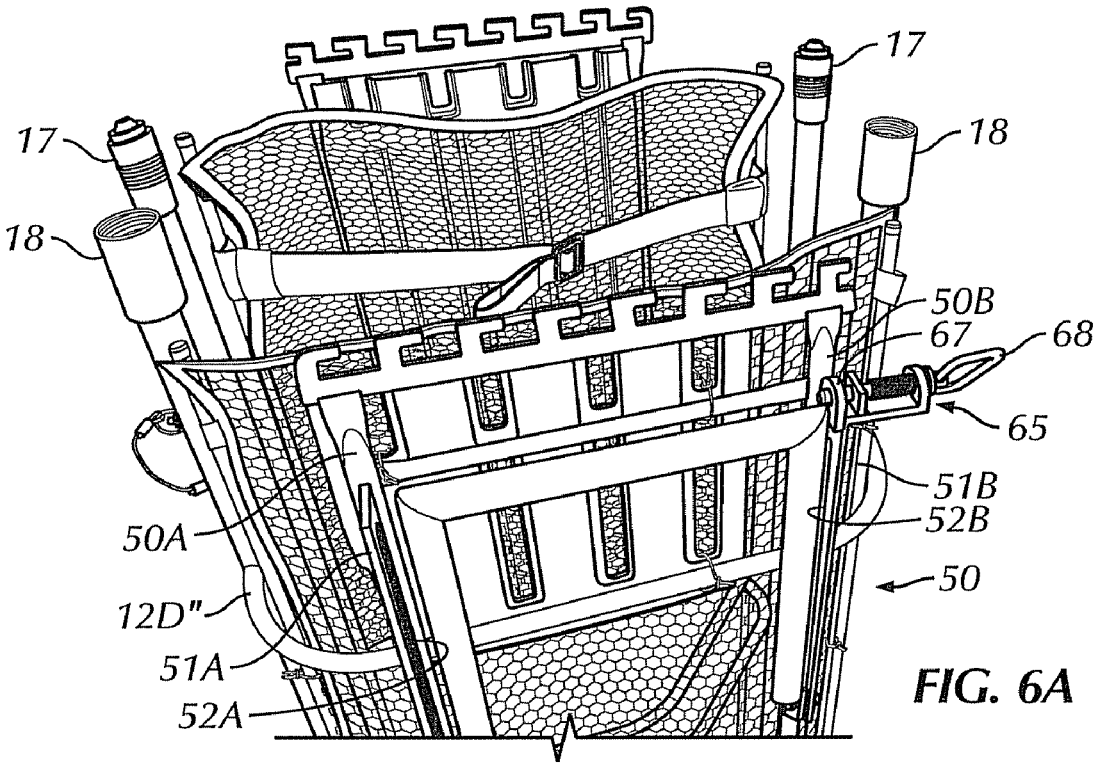
FIGS. 6A-6C illustrate the preferred extendable handle in a locked transport position, in an unlocked position, and in a locked hauling position, respectively.
Figure 6B:
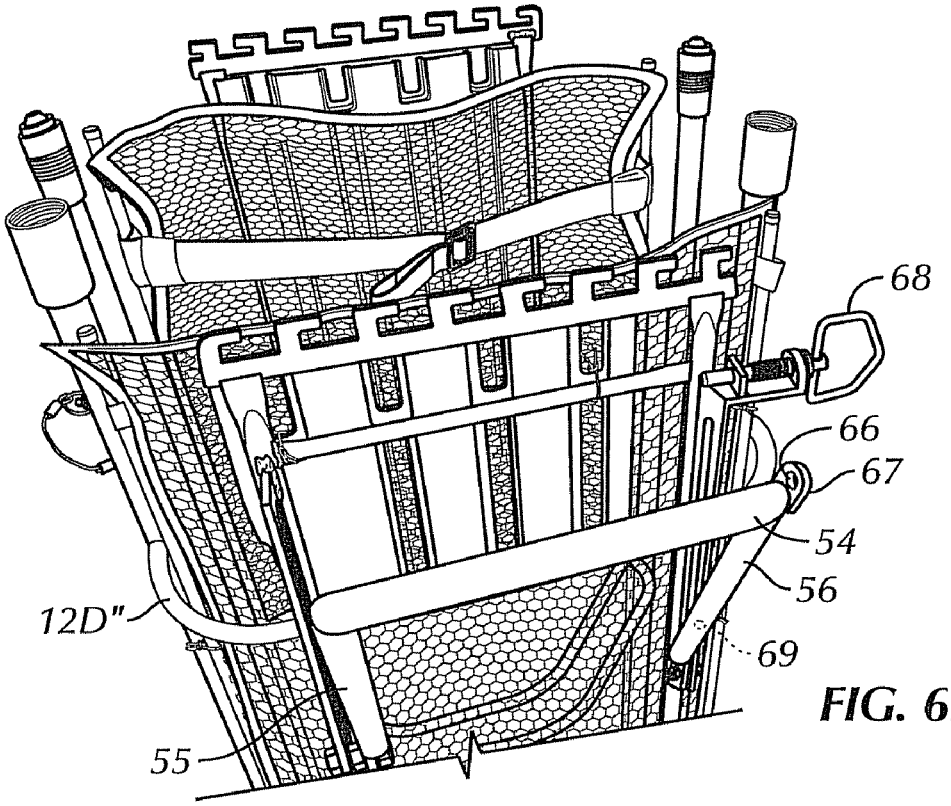
Figure 6C:
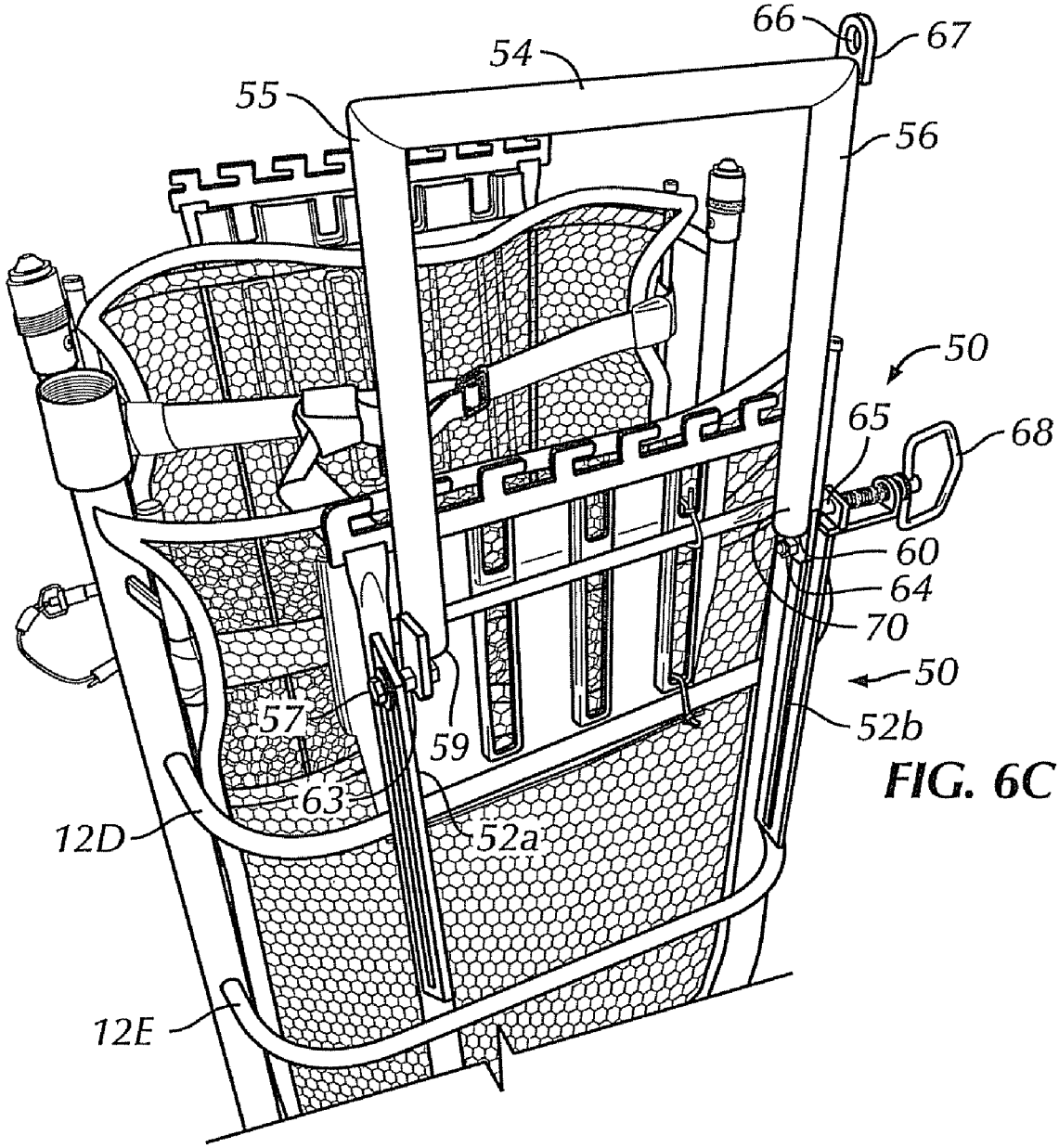

In another preferred embodiment as illustrated in FIGS. 6A-6C a handle assembly 50 is affixed to ribs 12D", 12E" to facilitate pulling or pushing basket 1 when in the equipment transport configuration. Handle assembly 50 comprises parallel frame members 50A, 50B affixed to one or more of head unit ribs 12. Slotted plates 51A, 51B extend perpendicularly from the frame members 50A, 50B whereby slots 52A, 52B of plates 51A, 51B, respectively are aligned with one another. Handle assembly 50 also comprises handle 54 affixed to parallel tubular members 55, 56. Each tubular member 55, 56 is provided with a bolt 57, 58, respectively, extending perpendicularly outward from the lower end 59, 60, respectively, at a position to extend through slots 52A, 52B, respectively. Each extending bolt end section 61, 62 of bolts 57, 58, respectively, is treaded to operatively receive a nut 63, 64, respectively. When bolts 57, 58 are positioned at the lower end of slots 52A, 52B, respectively, handle 54 can be positioned flush adjacent foot unit ribs 12 and locked in place by spring activated pin 65 that extends through opening 66 in handle flange 67. Pin 65 if provided with a gripping member 68 to facilitate pulling pin 65 in or out of opening 66 in a conventional manner. When pin 65 is pulled out opening 66, handle 54 can be tilted down as illustrated in FIG. 6B and pulled up to extend above basket 1 as illustrated in FIG. 6C. In the extended position pin 65 is inserted in opening 69 located in the lower end 70 of tubular member 56 to lock handle 54 in the extended position. Thus, this preferred embodiment provides a handle assembly that can be positioned in a compact manner that will not interfere with the transport of basket 1, but when locked in the extended position provides a sturdy aid useful in the pushing or pulling of the basket 1 when loaded with rescue equipment.

There are other embodiments of the invention obvious from the above descriptions that are intended to be included within the scope of the invention defined by the following claims.

What I claim is:

1. A split-apart basket stretcher having a first unit rigidly connectable to a second unit, each unit constructed of at least one longitudinal member having a generally U-shaped construction forming separated leg sections connected by a middle section and of at least one lateral structure extending between and connected at its opposite ends to the separated leg sections, the leg sections of the longitudinal member of the first unit being alignable with and attachable to the leg sections of the at least one longitudinal member of the second unit, the improvement to which comprises:

(a) a first strut fixed to extend vertically upward from one of the first unit leg sections;

(b) a second strut fixed to extend vertically upward from the other of the first unit leg sections;

(c) a third strut fixed to extend vertically upward from the first unit middle section;

(d) a first plate fixed to extend vertically upward from one of the second unit leg sections and shaped to attach to the first strut when the first unit and second unit face one another and are separated by a predetermined distance;

(e) a second plate fixed to extend vertically upward from the other of the second unit leg sections and shaped to attach to the second strut when the first and second units face one another and are separated by the predetermined distance;

(f) a third plate fixed to extend vertically upward from the second unit middle section and shaped to attach to the third strut when the first and second units face one another and are separated by the predetermined distance (g) a first attaching means for connecting the first strut to the first plate;

(h) a second attaching means for connecting the second strut to the second plate; and (i) a third attaching means for connecting the third strut to the third plate.

2. An apparatus according to claim 1 wherein the first unit and the second unit are each constructed of more than one longitudinal vertically spaced members, one of the members being a top rail, the leg sections of the longitudinal members of the first unit being alignable with and attachable to the corresponding leg sections of the longitudinal members of the second unit, and further comprising a two-piece, non-metallic netting having a first piece attached to the top rail of the first unit and a second piece attached to the top rail of the second unit to form at least partial floor and side walls for the stretcher.

3. An apparatus according to claim 1 further comprising a pair of separated wheels rotatably mounted to an axle affixed to the at least one longitudinal member of the first unit.

4. An apparatus according to claim 1 wherein the first and second struts are positioned opposite one another.

5. An apparatus according to claim 4 wherein the third strut is positioned to extend vertically upward from the center area of the first unit middle section.

6. An apparatus according to claim 5 wherein the predetermined distance is sufficient to permit the attached first and second units to form a pocket of sufficient size to permit storage of predetermined rescue equipment.

7. An apparatus according to claim 6 wherein a. the first unit and the second unit are each constructed of more than one longitudinal vertically spaced member, one of the members being a top rail, b. the leg sections of the longitudinal members of the first unit being alignable with and attachable to the corresponding leg sections of the longitudinal members of the second unit, and c. a two-piece, non-metallic netting having a first piece attached to the top rail of the first unit and a second piece attached to the top rail of the second unit to form at least partial floor and side walls for the pocket.

8. An apparatus according to claim 1 wherein:

a. each of the first and second struts comprise a first, a second and a third tubular section;

b. one end of the first tubular section being affixed at an angle to one end of the third tubular section and one end of the second tubular section being affixed at a corresponding angle to the opposite end of the third tubular section;

c. the opposite end of the first tubular section and the opposite end of the second tubular section being affixed to its corresponding leg section to position the third tubular section parallel to its corresponding leg member.

9. An apparatus according to claim 8 wherein each third tubular section having separated shoulder members extending vertically upward; each shoulder member having an opening alignable with the opening in the other shoulder member.

10. An apparatus according to claim 9 wherein a. each plate is shaped to have an area positionable between the separated shoulder members of the corresponding stmt third tubular section;

b. the area provided with an opening alignable with the shoulder member openings; and c. the corresponding attaching means is selected from a bolt or a cotter pin.

* * * * *